United States Patent [19]

VanDeusen et al.

[11] Patent Number: 4,943,688

[45] Date of Patent: Jul. 24, 1990

[54] RIBBON COAXIAL CABLE WITH OFFSET DRAIN WIRES

[75] Inventors: Herbert VanDeusen, Bear; John A. Voltz, Newark, both of Del.

[73] Assignee: W. L. Gore & Associtcs, Inc., Newark, Del.

[21] Appl. No.: 267,140

[22] Filed: Nov. 4, 1988

[51] Int. Cl.[5] ..... H01B 7/18

[52] U.S. Cl. ..... 174/103; 174/36; 174/115; 174/117 F

[58] Field of Search ..... 174/103 R, 115, 117 F, 174/36

[56] References Cited

U.S. PATENT DOCUMENTS

| | | | |
|---|---|---|---|
| 3,775,552 | 11/1973 | Schumacher | 174/105 R |
| 4,234,759 | 11/1980 | Harlow | 174/104 |
| 4,588,852 | 5/1986 | Fetterolf et al. | 174/36 |
| 4,642,480 | 2/1987 | Hughes et al. | 174/117 F X |
| 4,719,319 | 1/1988 | Tighe, Jr. | 174/117 F X |

FOREIGN PATENT DOCUMENTS

| | | | |
|---|---|---|---|
| 0213616 | 3/1987 | European Pat. Off. | 174/117 F |

*Primary Examiner*—Morris H. Nimmo

*Attorney, Agent, or Firm*—Gary A. Samuels

[57] ABSTRACT

A ribbon coaxial cable having precisely spaced conductors and drain wires separated by a dielectric spacer, conductor and spacer shielded together, and units jacketed to give cable having wires exactly positioned for termination.

9 Claims, 2 Drawing Sheets

RIBBON COAXIAL CABLE WITH OFFSET DRAIN WIRES

FIELD OF THE INVENTION

This invention relates to electrical cables and more particularly to ribbon coaxial cables having evenly spaced center conductors and conductive drain wires, so that the cable may be terminated by automatic equipment.

BACKGROUND OF THE INVENTION

A ribbon coaxial cable of the type disclosed in U.S. Pat. No. 3,775,552 comprises a flat cable assembly of individually insulated conductors and drain wires sandwiched between layers of conductive shielding material, such as metal foil, and covered by electrical insulation material. Also disclosed are coaxial cables having a conductive metal shield surrounding the cable and a conductive drain wire within the shield, the shielded whole being covered by an insulating jacket or sheath. The center conductors and associated drain wires are said to be coplanar, precisely spaced and locatable in a common insulation layer where they can be easily found for termination of the cable following stripping or for mass termination by methods utilizing penetration of the common insulation and shielding layers.

Where closer spacing of the conductors was necessary, the drain wires were disposed between alternate pairs of conductors as shown in U.S. Pat. No. 4,234,759, and the drain wires were outside of the shields, but adjacent and touching two of them.

To improve such cables to solve problems of discontinuities and others attributed to flexing, torquing, vibration, etc., U.S. Pat. No. 4,588,852 disclosed the placing of a ground conductor inside the shield of each signal conductor adjacent the insulating material surrounding the signal conductor, then surrounding the shield with a layer of elastomeric material to ensure and maintain continuous electrical engagement of the drain and shield conductor along the length of the cable.

SUMMARY OF THE INVENTION

The present invention, a ribbon coaxial electrical cable, comprises a plurality of parallel coplanar center conductors, each surrounded by a separate layer of insulation, a plurality of drain conductors parallel to the center conductors, a plurality of insulative spacers between each insulated center conductor and its respective associated drain wire, a conductive shield surrounding each associated center conductor, spacer, and drain wire, and a protective insulative thermoplastic outer jacket holding in fixed evenly spaced planar relationship the plurality of shielded associated conductors, spacers, and drain wires.

DESCRIPTION OF THE PREFERRED EMBODIMENTS

The preferred embodiments of the invention are flat coaxial ribbon cables wherein the drain wires are deliberately spaced away from the cores to achieve a desired precise even spacing between drain and center conductors in order to make the cable easily mass terminated.

Figure 1:
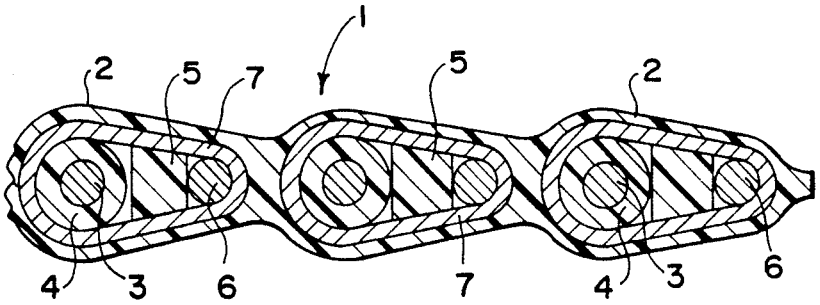
FIG. 1 is a cross-section of a segment of cable.
Figure 2:
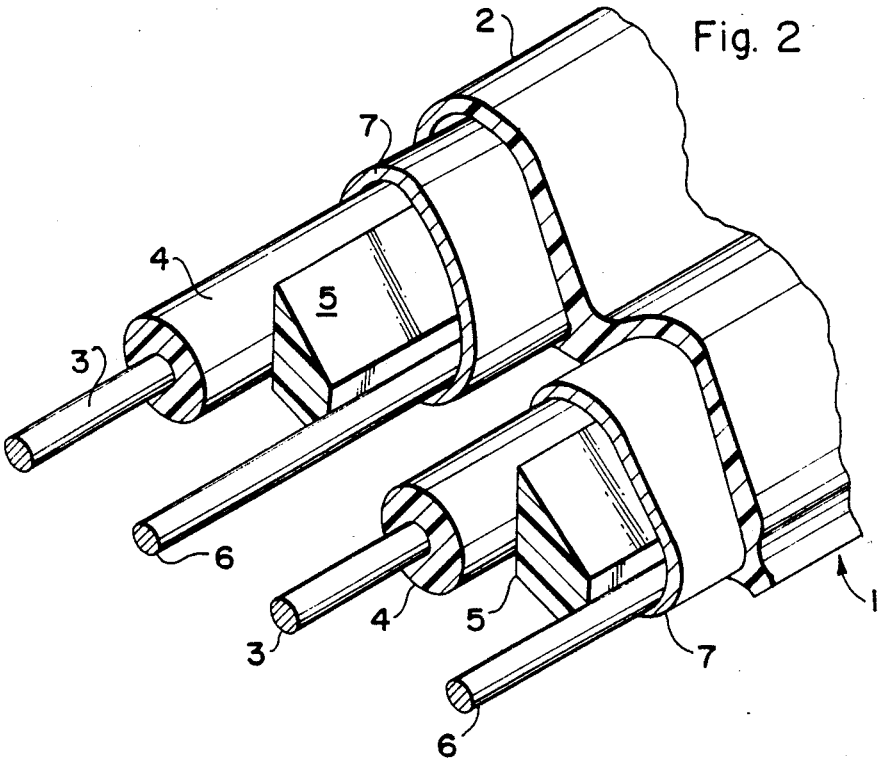
FIG. 2 shows a perspective cross-section of a segment of cable showing layers stripped off to better show the relationship, size and spacing of elements.

FIG. 1 illustrates a cable 1 of the invention by a cross-section of a segment of the cable where each center signal conductor 3 and each associated drain wire 6 has been precisely spaced from the other and from the other conductors in the cable. To provide a way to fix exactly and predictably this spacing and to adjust or change it for each run of cable to effect a change in insulation properties or to tailor a cable precisely for termination to a particular connector or printed circuit board (PCB), an elongated shaped strand 5 of dielectric insulation is placed between the insulated center conductor 3 and drain wire 6. Each insulated signal conductor 3 along with its associated spacer 5 of dielectric material and conductive drain wire 6 is then wrapped in conductive shielding material 7. A selected number of these shielded units are then cabled together in a precise manner in a protective jacket 2 such that all center and drain conductors are equally spaced apart in the same plane. FIG. 2 illustrates in perspective cross-section cable 1 to show how each insulated center conductor 3 fits together with its associated spacer 5 of insulation between it and its drain wire 6, how they fit together inside conductive shielding 7, and how as many of these associated units as are needed for a cable 1 are cabled together inside a thermoplastic polymeric protective jacket 2 to form a flat ribbon cable of the invention.

Figure 3:
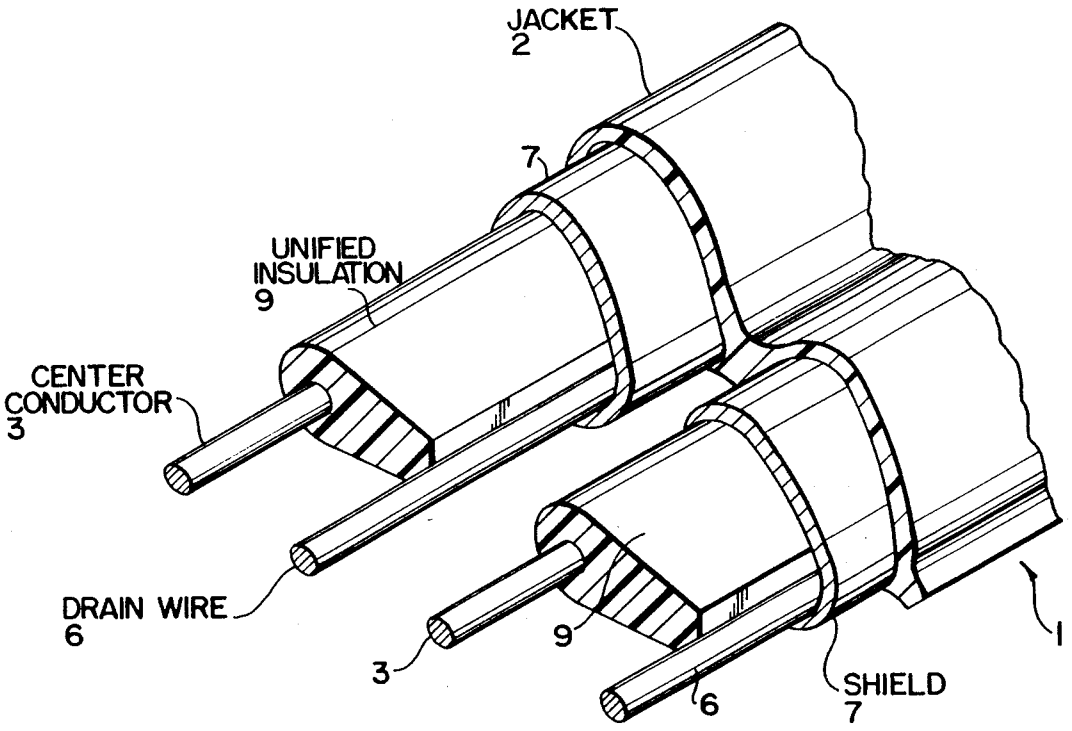
FIG. 3 depicts one embodiment of the invention.

The center conductors may be any of the steel, copper, copper alloy, aluminum, or plated conductors normally utilized in cables presently being manufactured in the art. Silver, tin, and nickel plated copper are preferred conductor materials which are also preferred as the drain wires. The other conductors above may also be used for the conductive drain wire. As the dielectric surrounding the center conductor is preferred the porous expanded polytetrafluoroethylene (EPTFE) as disclosed in any of U.S. Pat. Nos. 3,953,566, 3,962,153, 4,096,227, 4,110,392, and 4,187,390. The same porous EPTFE material is also preferred for the spacer 5 between the insulated center conductor 3 and the drain wire 6. Other insulative materials may be used for spacer 5 and insulation 4, but porous EPTFE is preferred. The materials used for Spacer 5 and insulation 4 may differ from each other in dielectric constant or other properties, and may differ from each other within the same cable, in order to provide the desired electrical and insulative properties while maintaining even center conductor and drain wire spacing. Spacer 5 and insulation 4 may also be formed together in a single operation, such as extrusion, for example, or may be bonded together by an adhesive or heat sealing. For conductive shield 7 material, either served conductive metal foil, served metal wire, metallized plastic tape, braided metal wire, or braided metal foil strips may be utilized, the preferred shielding being metallized plastic tape, such as aluminized polyester. The protective jacket 2 placed on the outside of the cable is usually a thermoplastic polymer or rubber jacket, most often applied by extrusion. It may be of polyvinyl chloride, polyurethane, polyethylene, rubber or other extrudable thermoplastic material and may be pigmented or filled with materials to change characteristics other than color, such as to affect electrical properties or to protect the cable against outside effects such as abrasion, cutting, radiation of various kinds, signal interferance and others. FIG. 3 illustrates a cable 1 of the invention by a cross section of a segment of the cable wherein the insulation surrounding each center conductor 3 and the adjacent associated insulative spacer are combined by being formed as one unit 9 from the same insulation in a single operation, such as extrusion for example.

The advantage of the invention is the precise spacing of the wires which allows exact positioning of the cable end over termination points of a connector or PCB.

Other variation and changes of materials and methods may be made by those skilled in the art without departing from the essential nature and concept of the invention, the scope of which is delineated only by the appended claims.

We claim:

1. A ribbon coaxial cable comprising:

(a) a plurality of elongated and conductive center conductors;

(b) a plurality of elongated and insulative spacers parallel with said center conductors;

(c) a plurality of elongated and conductive drain conductors parallel with said insulative spacers and said center conductors and arranged such that a drain conductor is adjacent each center conductor and a spacer is located between each center conductor and its drain conductor, each center conductor being surrounded concentrically by a separate layer of dielectric insulation, each center conductor and its adjacent associated spacer and drain conductor surrounded as a unit by a conductive outer shielding in contact with said drain conductor; and (d) a thermoplastic outer dielectric jacket surrounding said outer conductive shielding, said center conductors, said spacers, and said drain conductors to hold said center conductors and said drain conductors in mutually evenly spaced-apart parallel configuration.

2. A cable of claim 1 wherein said spacer and said insulation surrounding said center conductor comprise porous expanded polytetrafluoroethylene.

3. A cable of claim 2 wherein the outer shielding surrounding each center conductor and its adjacent associated spacer and drain conductor is selected from the group served conductive metal foil tape, sewed metallized plastic tape, served metal wire, braided metal wire, braided metal foil, and combinations thereof.

4. A cable of claim 2 wherein the thermoplastic jacket is selected from the group polyvinyl chloride, polyethylene, polyurethane, and rubber.

5. A cable of claim 1 wherein the insulation surrounding each center conductor and the adjacent associated insulative spacer are combined by being formed as one unit from the same insulation.

6. A cable of claim 1 wherein separately formed insulation surrounding each center conductor and the adjacent associated insulative spacer are bonded together into one unit.

7. A cable of claim 1, 5, or 6 wherein said spacers comprise a single insulative material having different dielectric properties from the insulation surrounding the center conductor.

8. A cable of claim 1, 5, or 6 wherein said spacers comprise insulative materials having different dielectric properties from the insulation surrounding said center conductors and from at least one of each other spacer within said cable.

9. A cable of claim 7 wherein the insulation surrounding some center conductors and comprising some spacers differs from other said insulations within said cable.

* * * * *